US007651323B2

(12) United States Patent
Hwang et al.

(10) Patent No.: US 7,651,323 B2
(45) Date of Patent: Jan. 26, 2010

(54) SMART CONTROL VALVE FOR COMPRESSORS

(75) Inventors: Seon-woong Hwang, Anyang-Si (KR); Dong-won Yoo, Seoul (KR)

(73) Assignee: LG Electronics Inc., Seoul (KR)

( * ) Notice: Subject to any disclaimer, the term of this patent is extended or adjusted under 35 U.S.C. 154(b) by 724 days.

(21) Appl. No.: 11/208,720

(22) Filed: Aug. 23, 2005

(65) Prior Publication Data

US 2006/0127236 A1 Jun. 15, 2006

(30) Foreign Application Priority Data

Dec. 14, 2004 (KR) ..... 10-2004-0105659

(51) Int. Cl.
*F04B 49/00* (2006.01)

(52) U.S. Cl. ..... 417/310; 417/212; 137/625.29; 137/625.48

(58) Field of Classification Search ..... 417/212, 417/213, 283, 310; 137/625.29, 625.2, 625.42, 137/625.43, 625.48
See application file for complete search history.

(56) References Cited

U.S. PATENT DOCUMENTS 3,125,031 A * 3/1964 Rydberg ..... 418/59
3,977,433 A * 8/1976 Hankison et al. ..... 137/625.29
4,469,133 A * 9/1984 Boesing et al. ..... 137/625.29
4,558,993 A * 12/1985 Hori et al. ..... 417/283
4,621,986 A * 11/1986 Sudo ..... 417/304
5,383,773 A * 1/1995 Richardson, Jr. ..... 418/57
6,524,076 B2 * 2/2003 Konishi ..... 417/213
6,551,069 B2 * 4/2003 Narney et al. ..... 417/53

OTHER PUBLICATIONS

U.S. Appl. No. 11/208,655 to Hwang et al., which was filed on Aug. 23, 2005.

* cited by examiner

*Primary Examiner*—Devon C Kramer
*Assistant Examiner*—Peter J Bertheaud
(74) *Attorney, Agent, or Firm*—Birch, Stewart, Kolasch & Birch, LLP

(57) ABSTRACT

Disclosed herein is a smart control valve for compressors that is capable of easily accomplishing compression and communication in a compression chamber of a cylinder, without performing the repetitive on/off operation of the compressor, to change the capacity of the compressor. The smart control valve comprises a valve body mounted on a cylinder including refrigerant inlet and outlet ports, a valve inlet port formed at the valve body and communicating with the refrigerant inlet port of the cylinder, a valve outlet port formed at the valve body and communicating with the refrigerant outlet port of the cylinder, an actuating groove disposed under the valve inlet port and the valve outlet port of the valve body, and an actuator disposed in the actuating groove for performing a linear reciprocating movement in the actuating groove as a solenoid is operated.

2 Claims, 9 Drawing Sheets

SMART CONTROL VALVE FOR COMPRESSORS

BACKGROUND OF THE INVENTION

1. Field of the Invention

The present invention relates to a compressor, and, more particularly, to a smart control valve for compressors that is capable of easily accomplishing compression and communication in a compression chamber of a cylinder, without performing the repetitive on/off operation of the compressor, to change the capacity of the compressor.

2. Description of the Related Art

Generally, a refrigerating apparatus or an air conditioning apparatus, such as a refrigerator or an air conditioner, changes the state of refrigerant according to the principle of a refrigerating cycle to consecutively perform compressing, condensing, expanding and evaporating processes to maintain the interior of the refrigerating apparatus in a refrigerated state or the interior of a room where the air conditioning apparatus is installed in an air-conditioned state. To this end, the refrigerating apparatus or the air conditioning apparatus includes a compressor, a condenser, an expansion mechanism, and an evaporator.

The compressor serves to compress low-temperature and low-pressure refrigerant gas introduced into the compressor from the evaporator to change the low-temperature and low-pressure refrigerant gas into high-temperature and high-pressure refrigerant gas. Based on the structure, compressors are classified into an open-type compressor and a sealed-type compressor. The sealed-type compressor, including a drive unit and a compression unit mounted in a hermetically sealed container, is usually used in the refrigerator or the air conditioner. Based on the compression method, sealed-type compressors are classified into a reciprocating compressor, a centrifugal compressor, a rotary compressor, and a scroll compressor.

Meanwhile, an energy-saving operation of a refrigerating apparatus or an air conditioning apparatus, such as a refrigerator or an air conditioner, is generally performed as follows. When the temperature in the refrigerator or the temperature in a room where the air conditioner is installed reaches a predetermined temperature, the operation of the compressor of the refrigerator or the air conditioner is stopped. When the temperature in the refrigerator or the temperature in the room exceeds the predetermined temperature, on the other hand, the operation of the compressor of the refrigerator or the air conditioner is initiated. In this way, the operation of the compressor is repetitively turned on and off. Generally, power consumption when the operation of the compressor is initiated is greater than power consumption when the compressor is normally operated. Furthermore, interference between the compressed gas in the compressor and the parts of the compressor is caused due to abrupt interruption of the compressor and initiation of the compressor, and therefore, the parts of the compressor are prematurely worn, which reduces the service life of the compressor.

For this reason, it is required to change the capacity of the compressor without performing repetitive on/off operation of the compressor as described above. An inverter system may be used to change the capacity of the compressor. In the inverter system, the number of rotations of the motor is controlled to change the capacity of the compressor. However, the inverter system has problems in that expensive electric circuit control devices and relevant parts are needed. Consequently, the manufacturing costs of the compressor are increased, and therefore, the competitiveness of the product is decreased.

SUMMARY OF THE INVENTION

Therefore, the present invention has been made in view of the above problems, and it is an object of the present invention to provide a smart control valve for compressors that is capable of easily accomplishing compression and communication in a compression chamber of a cylinder, without performing the repetitive on/off operation of the compressor, to change the capacity of the compressor, thereby reducing power consumption due to repetitive on/off operation of the compressor, preventing reduction in service life of the compressor due to premature wear of the parts of the compressor, and accomplishing economical efficiency of the compressor.

In accordance with the present invention, the above and other objects can be accomplished by the provision of a smart control valve for compressors, comprising: a valve body mounted on a cylinder including a refrigerant inlet port and a refrigerant outlet port; a valve inlet port formed at the valve body, the valve inlet port communicating with the refrigerant inlet port of the cylinder; a valve outlet port formed at the valve body, the valve outlet port communicating with the refrigerant outlet port of the cylinder; an actuating groove disposed under the valve inlet port and the valve outlet port of the valve body, the actuating groove being opened at one side thereof; and an actuator disposed in the actuating groove for performing a linear reciprocating movement in the actuating groove as a solenoid is operated.

Preferably, the cylinder further includes an annular space defined between an inner ring and an inner wall thereof, and the smart control valve further comprises: an orbiting vane, having a circular vane, disposed in the annular space.

Preferably, the annular space of the cylinder is divided into inner and outer compression chambers by the circular vane of the orbiting vane.

Preferably, the cylinder further includes: inner refrigerant inlet and outlet ports communicating the inner compression chamber; and outer refrigerant inlet and outlet ports communicating the outer compression chamber, the inner refrigerant inlet and outlet ports being opposite to the outer refrigerant inlet and outlet ports about the valve body.

Preferably, the actuator includes: a discharge side opening/closing hole formed at the other longitudinal side thereof for allowing or interrupting communication between the valve outlet port and the refrigerant outlet port of the cylinder; and a communication groove formed at the other longitudinal side thereof, the communication groove having an open side.

Preferably, the actuator includes: a discharge side opening/closing hole formed at the other longitudinal side thereof for allowing or interrupting communication between the valve outlet port and the refrigerant outlet port of the cylinder; an elongated suction hole formed at the other longitudinal side thereof for maintaining communication between the valve inlet port and the refrigerant inlet port of the cylinder; and a communication groove disposed under the elongated suction hole, the communication groove extending toward the discharge side opening/closing hole and opposite ends of the communication groove being closed.

Preferably, the actuator includes: a communication groove formed at the lower part thereof, opposite ends of the communication groove being closed; a suction side opening/closing hole disposed above the communication groove adjacent to one side of the lower communication groove, the suction side opening/closing hole communicating with the communication groove; a communication hole disposed above the communication groove adjacent to the other side of the lower communication groove, the communication hole communicating with the communication groove; and a discharge side opening/closing hole disposed adjacent to the communication hole for allowing or interrupting communication between the valve outlet port and the refrigerant outlet port of the cylinder.

Preferably, the actuator includes: a discharge side opening/closing hole formed at one longitudinal side thereof for allowing or interrupting communication between the valve outlet port and the refrigerant outlet port of the cylinder; an elongated suction hole formed at the other longitudinal side thereof for maintaining communication between the valve inlet port and the refrigerant inlet port of the cylinder; a communication groove formed at the lower part thereof between the elongated suction hole and the discharge side opening/closing hole, opposite ends of the communication groove being closed; and a suction guide disposed between the elongated suction hole and the communication groove. Also, the cylinder includes an upper open groove disposed between the refrigerant inlet port thereof and the refrigerant outlet port thereof, the upper open groove being opposite to the communication groove of the actuator.

Preferably, the actuator includes: a discharge side opening/closing hole formed at one longitudinal side thereof for allowing or interrupting communication between the valve outlet port and the refrigerant outlet port of the cylinder; a suction side opening/closing hole formed at the other longitudinal side thereof for allowing or interrupting communication between the valve inlet port and the refrigerant inlet port of the cylinder; a communication hole disposed between the suction side opening/closing hole and the discharge side opening/closing hole; a first communication groove disposed under the suction side opening/closing hole, the first communication groove communicating with the suction side opening/closing hole and opposite ends of the first communication groove being closed; a second communication groove disposed under the communication hole, the second communication groove communicating with the communication hole and opposite ends of the second communication groove being closed; and a suction guide disposed between the first communication groove and the second communication groove. Also, the cylinder includes an upper open groove disposed between the refrigerant inlet port thereof and the refrigerant outlet port thereof, the upper open groove being opposite to the second communication groove of the actuator.

Preferably, the actuator includes: first and second discharge side opening/closing holes formed at one longitudinal side thereof for allowing or interrupting communication between the valve outlet port and the refrigerant outlet port of the cylinder; an elongated suction hole formed at the other longitudinal side thereof for maintaining communication between the valve inlet port and the refrigerant inlet port of the cylinder; a communication groove formed at the lower part thereof between the elongated suction hole and the first discharge side opening/closing hole, the communication groove communicating with the second discharge side opening/closing hole and opposite ends of the communication groove being closed; and a suction guide disposed between the elongated suction hole and the communication groove. Also, the cylinder includes an upper open groove disposed between the refrigerant inlet port thereof and the refrigerant outlet port thereof, the upper open groove being opposite to the communication groove of the actuator.

BRIEF DESCRIPTION OF THE DRAWINGS

The above and other objects, features and other advantages of the present invention will be more clearly understood from the following detailed description taken in conjunction with the accompanying drawings, in which:

FIGS. 2A to 2C illustrate a smart control valve for compressors according to a first preferred embodiment of the present invention, in which FIG. 2A is a perspective view illustrating an actuator, FIG. 2B is a sectional view illustrating a compression state, and FIG. 2C is a sectional view illustrating a communication state;

FIGS. 3A to 3C illustrate a smart control valve for compressors according to a second preferred embodiment of the present invention, in which FIG. 3A is a perspective view illustrating an actuator, FIG. 3B is a sectional view illustrating a compression state, and FIG. 3C is a sectional view illustrating a communication state;

FIGS. 4A to 4C illustrate a smart control valve for compressors according to a third preferred embodiment of the present invention, in which FIG. 4A is a perspective view illustrating an actuator, FIG. 4B is a sectional view illustrating a compression state, and FIG. 4C is a sectional view illustrating a communication state;

FIGS. 5A to 5C illustrate a smart control valve for compressors according to a fourth preferred embodiment of the present invention, in which FIG. 5A is a perspective view illustrating an actuator, FIG. 5B is a sectional view illustrating a compression state, and FIG. 5C is a sectional view illustrating a communication state;

FIGS. 6A to 6C illustrate a smart control valve for compressors according to a fifth preferred embodiment of the present invention, in which FIG. 6A is a perspective view illustrating an actuator, FIG. 6B is a sectional view illustrating a compression state, and FIG. 6C is a sectional view illustrating a communication state;

FIGS. 7A to 7C illustrate a smart control valve for compressors according to a sixth preferred embodiment of the present invention, in which FIG. 7A is a perspective view illustrating an actuator, FIG. 7B is a sectional view illustrating a compression state, and FIG. 7C is a sectional view illustrating a communication state;

DESCRIPTION OF THE PREFERRED EMBODIMENTS

Now, preferred embodiments of the present invention will be described in detail with reference to the accompanying drawings.

Figure 1:
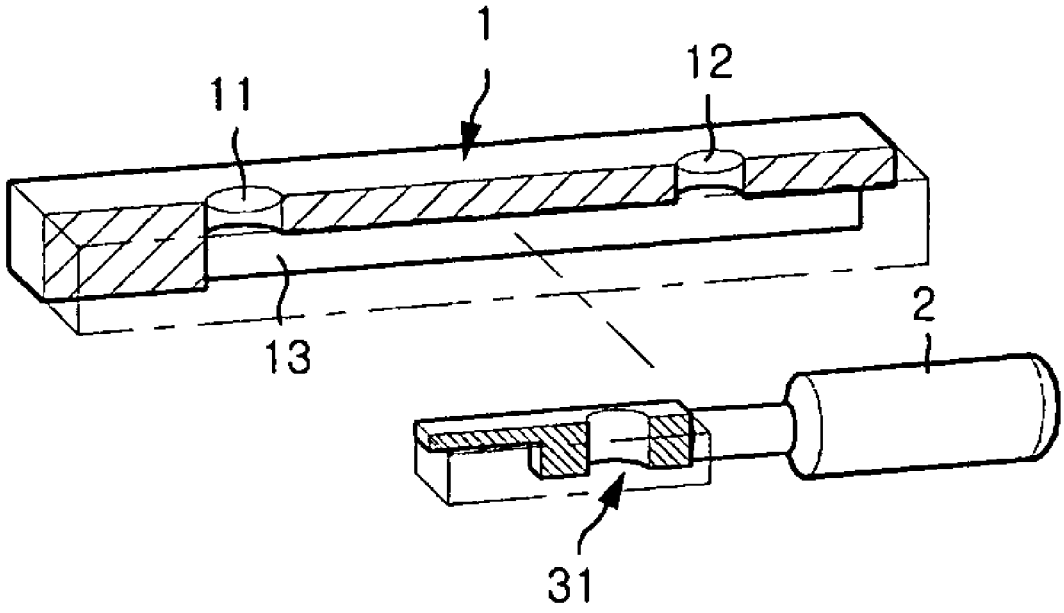
FIG. 1 is an exploded perspective view illustrating the overall structure of a smart control valve for compressors according to the present invention.

FIG. 1 is an exploded perspective view illustrating the overall structure of a smart control valve for compressors according to the present invention.

As shown in FIG. 1, the smart control valve for compressors comprises: a valve body 1 mounted in a cylinder having a refrigerant inlet port and a refrigerant outlet port; and an actuator 3 connected to a solenoid 2 for performing a linear reciprocating movement in the valve body 1 as the solenoid 2 is operated.

The valve body 1 has a valve inlet port 11, which corresponds to the refrigerant inlet port of the cylinder, and a valve outlet port 12, which corresponds to the refrigerant outlet port of the cylinder. Under the valve inlet port 11 and the valve outlet port 12 is disposed an actuating groove 13, which is opened at one side thereof.

The actuator 3 is disposed in the actuating groove 13. The actuator 3 is linearly reciprocated, as the solenoid 2 is operated, to allow or interrupt communication between the refrigerant inlet port of the cylinder and the valve inlet port 11 and between the refrigerant outlet port of the cylinder and the valve outlet port 12. When the communication is interrupted between the refrigerant inlet port of the cylinder and the valve inlet port 11 and between the refrigerant outlet port of the cylinder and the valve outlet port 12, compression is performed in the cylinder. When the communication is allowed between the refrigerant inlet port of the cylinder and the valve inlet port 11 and between the refrigerant outlet port of the cylinder and the valve outlet port 12, on the other hand, compression is not performed in the cylinder.

According to the present invention, the actuator 3 may take various shapes, which will be described hereinafter in detail with reference to the accompanying drawings.

Figure 2A:
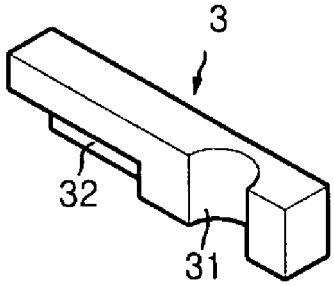
Figure 2B:
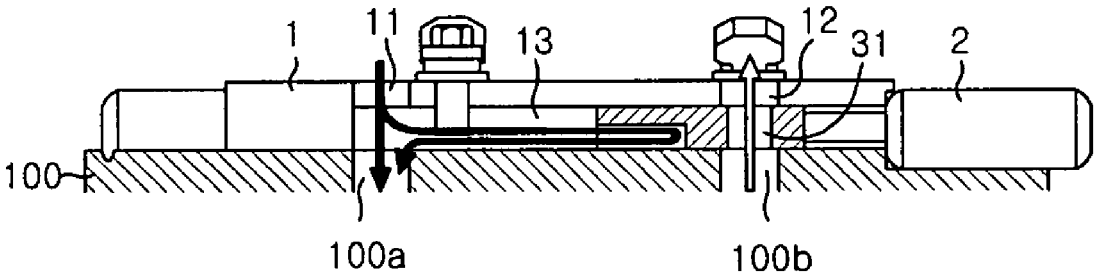
Figure 2C:
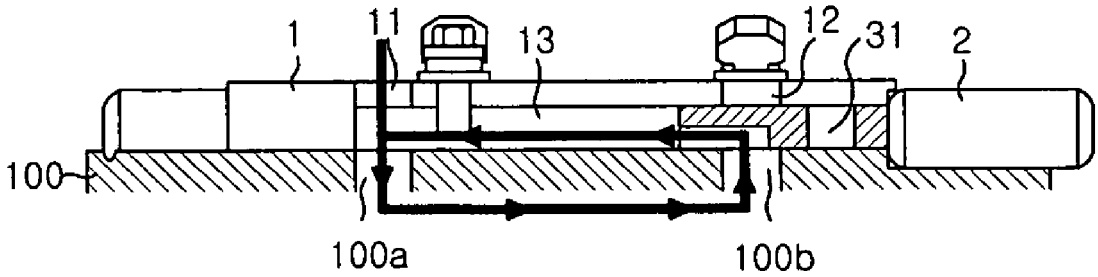

FIGS. 2A to 2C illustrate a smart control valve for compressors according to a first preferred embodiment of the present invention.

FIG. 2A is a perspective view illustrating an actuator 3. As shown in FIG. 2A, the actuator 3 has a discharge side opening/closing hole 31 formed at one longitudinal side of the actuator 3. The discharge side opening/closing hole 31 vertically extends through the actuator 3. Also, the actuator 3 has a communication groove 32 formed at the other longitudinal side of the actuator 3. One side of the communication groove 32 is opened. The actuator 130 is connected to the solenoid 2, as shown in FIG. 2B. The actuator 3 performs a linear reciprocating movement in the actuating groove 13 of the valve body 1, as the solenoid 2 is operated, to accomplish compression and communication in a compression chamber of a cylinder 100, which will be described below in more detail with reference to FIGS. 2B and 2C.

When the actuator 3 is moved forward by the solenoid 2, as shown in FIG. 2B, the discharge side opening/closing hole 31 is aligned with a refrigerant outlet port 100*b* of the cylinder 100 and the valve outlet port 12. As a result, the refrigerant outlet port 100*b* of the cylinder 100 communicates with the valve outlet port 12 through the discharge side opening/closing hole 31. At this time, the communication groove 32 does not communicate with the refrigerant outlet port 100*b* of the cylinder 100.

Consequently, refrigerant gas introduced into the valve body 1 through the valve inlet port 11 flows along the actuating groove 13 and the communication groove 32, and then flows backward into the cylinder 100 through a refrigerant inlet port 100*a* of the cylinder 100. The refrigerant gas introduced into the cylinder 100 through the refrigerant inlet port 100*a* of the cylinder 100 is compressed in the cylinder 100, and is then discharged out of the cylinder 100 through the refrigerant outlet port 100*b* of the cylinder 100, the discharge side opening/closing hole 31 of the actuator 3, and the valve outlet port 12. In this way, compression in the compression chamber of the cylinder 100 is accomplished.

When the actuator 3 is moved rearward by the solenoid 2, as shown in FIG. 2C, on the other hand, the discharge side opening/closing hole 31 of the actuator 3 is not aligned with the refrigerant outlet port 100*b* of the cylinder 100 and the valve outlet port 12. As a result, the refrigerant outlet port 100*b* of the cylinder 100 does not communicate with the valve outlet port 12.

Consequently, refrigerant gas introduced into the cylinder 100 through the valve inlet port 11 and the refrigerant inlet port 100*a* of the cylinder 100 is compressed in the cylinder 100. However, the compressed refrigerant is not discharged out of the cylinder 100. Specifically, the compressed refrigerant is circulated along the actuating groove 13 of the valve body 1 through the communication groove 32. As a result, the refrigerant inlet port 100*a* of the cylinder 100 communicates with the refrigerant outlet port 100*b* of the cylinder 100.

Figure 3A:
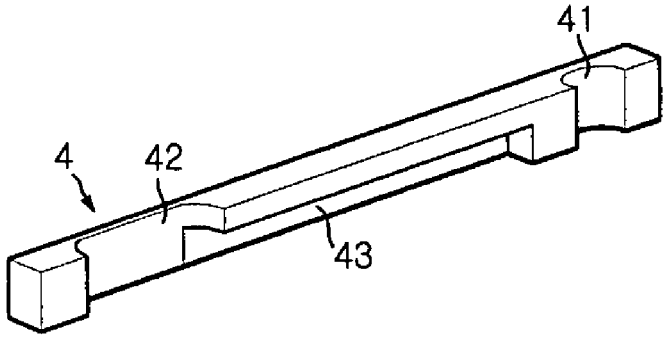
Figure 3B:
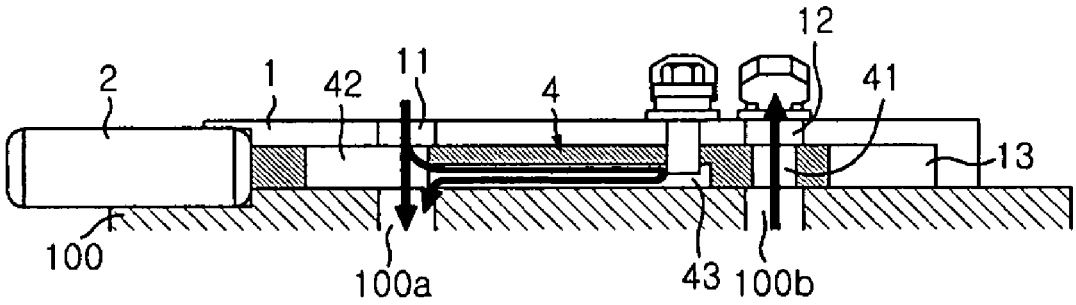
Figure 3C:
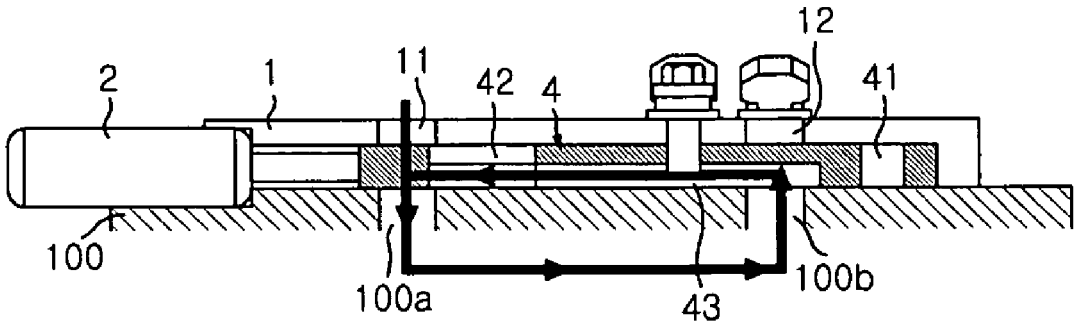

FIGS. 3A to 3C illustrate a smart control valve for compressors according to a second preferred embodiment of the present invention.

FIG. 3A is a perspective view illustrating an actuator 4. As shown in FIG. 3A, the actuator 4 has a discharge side opening/closing hole 41 formed at one longitudinal side of the actuator 4. The discharge side opening/closing hole 41 vertically extends through the actuator 4. Also, the actuator 4 has an elongated suction hole 42 formed at the other longitudinal side of the actuator 4. The elongated suction hole 42 has an elliptical section. Under the elongated suction hole 42 is disposed a communication groove 43, which extends toward the discharge side opening/closing hole 41. Opposite ends of the communication groove 43 are closed. The communication groove 43 communicates with the elongated suction hole 42. However, the communication groove 43 does not communicate with the discharge side opening/closing hole 41.

When the actuator 4 is moved rearward by the solenoid 2, as shown in FIG. 3B, the discharge side opening/closing hole 41 is aligned with the refrigerant outlet port 100*b* of the cylinder 100 and the valve outlet port 12. As a result, the refrigerant outlet port 100*b* of the cylinder 100 communicates with the valve outlet port 12 through the discharge side opening/closing hole 41. At this time, the communication groove 43 does not communicate with the refrigerant outlet port 100*b* of the cylinder 100.

Consequently, refrigerant gas introduced into the communication groove 43 of the actuator 4 through the valve inlet port 11 flows along the communication groove 43, and then flows backward into the cylinder 100 through the refrigerant inlet port 100*a* of the cylinder 100. The refrigerant gas introduced into the cylinder 100 through the refrigerant inlet port 100*a* of the cylinder 100 is compressed in the cylinder 100, and is then discharged out of the cylinder 100 through the refrigerant outlet port 100*b* of the cylinder 100, the discharge side opening/closing hole 41 of the actuator 4, and the valve outlet port 12. In this way, compression in the compression chamber of the cylinder 100 is accomplished.

When the actuator 4 is moved forward by the solenoid 2, as shown in FIG. 3C, on the other hand, the discharge side opening/closing hole 41 of the actuator 4 is not aligned with the refrigerant outlet port 100*b* of the cylinder 100 and the valve outlet port 12. At this time, the communication groove 43 communicates with the refrigerant outlet port 100*b* of the cylinder 100. Consequently, refrigerant gas introduced into the communication groove 43 of the actuator 4 through the valve inlet port 11 is introduced into the cylinder 100 through the refrigerant inlet port 100*a* of the cylinder 100.

The refrigerant gas introduced into the cylinder 100 is compressed in the cylinder 100. However, the compressed refrigerant is not discharged out of the cylinder 100. Specifically, the compressed refrigerant is circulated along the communication groove 43 of the actuator 4. As a result, the refrigerant inlet port 100*a* of the cylinder 100 communicates with the refrigerant outlet port 100*b* of the cylinder 100.

Figure 4A:
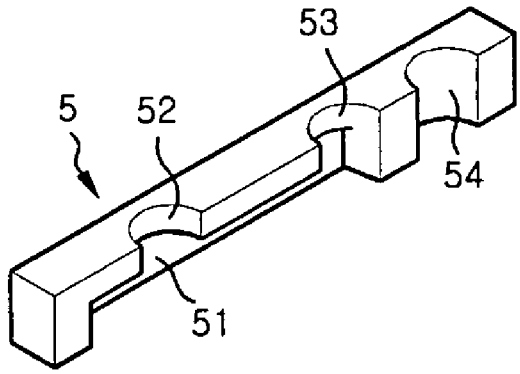
Figure 4B:
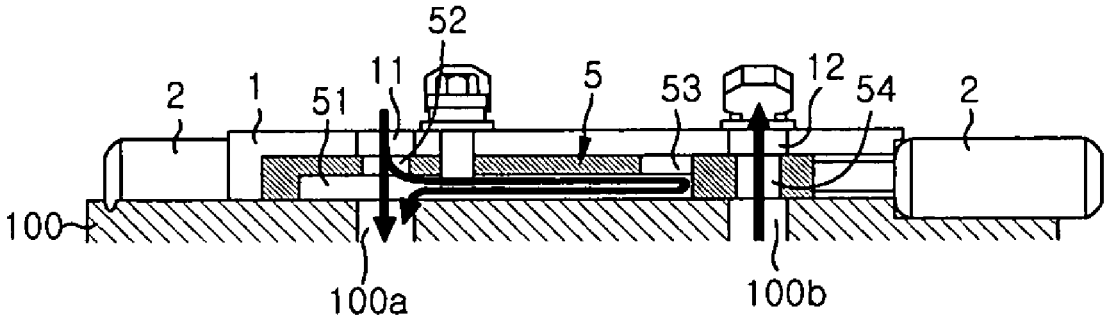
Figure 4C:
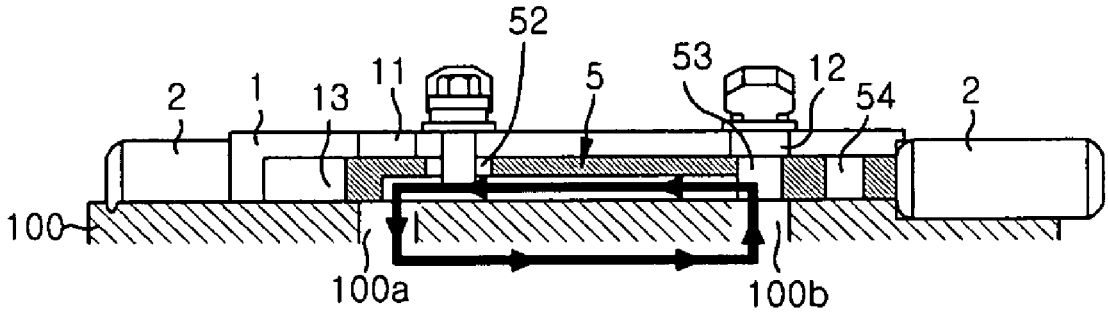

FIGS. 4A to 4C illustrate a smart control valve for compressors according to a third preferred embodiment of the present invention.

FIG. 4A is a perspective view illustrating an actuator 5. As shown in FIG. 4A, the actuator 5 has a communication groove 51, which is formed at the lower part of the actuator 5 and opposite ends of which are closed, and a suction side opening/closing hole 52, which is disposed above the lower communication groove 51 adjacent to one side of the lower communication groove 51. The suction side opening/closing hole 52 communicates with the lower communication groove 51. In addition, the actuator 5 has a communication hole 53, which is disposed above the lower communication groove 51 adjacent to the other side of the lower communication groove 51. The communication hole 53 communicates with the lower communication groove 51. At the actuator 5 is also formed a discharge side opening/closing hole 54, which is disposed adjacent to the communication hole 53. The discharge side opening/closing hole 54 vertically extends through the actuator 5.

When the actuator 5 is moved forward by the solenoid 2, as shown in FIG. 4B, the discharge side opening/closing hole 54 is aligned with the refrigerant outlet port 100*b* of the cylinder 100 and the valve outlet port 12. As a result, the refrigerant outlet port 100*b* of the cylinder 100 communicates with the valve outlet port 12 through the discharge side opening/closing hole 54. At this time, the communication groove 51 and the communication hole 53 do not communicate with the refrigerant outlet port 100*b* of the cylinder 100.

Consequently, refrigerant gas introduced into the communication groove 51 of the actuator 5 through the valve inlet port 11 and the suction side opening/closing hole 52 flows along the communication groove 51, and then flows backward into the cylinder 100 through the refrigerant inlet port 100*a* of the cylinder 100. The refrigerant gas introduced into the cylinder 100 through the refrigerant inlet port 100*a* of the cylinder 100 is compressed, and is then discharged out of the cylinder 100 through the refrigerant outlet port 100*b* of the cylinder 100, the discharge side opening/closing hole 54 of the actuator 5, and the valve outlet port 12. In this way, compression in the compression chamber of the cylinder 100 is accomplished.

When the actuator 5 is moved rearward by the solenoid 2, as shown in FIG. 4C, on the other hand, the discharge side opening/closing hole 54 and the suction side opening/closing hole 52 of the actuator 5 are not aligned with the refrigerant outlet port 100*b* of the cylinder 100 and the valve outlet port 12, and the valve inlet port 11, respectively. At this time, the communication groove 51 and the communication hole 53 communicate with the refrigerant inlet port 100*a* of the cylinder 100, and the refrigerant outlet port 100*b* of the cylinder 100 and the valve outlet port 12, respectively.

Consequently, refrigerant gas introduced into the cylinder 100 through the refrigerant inlet port 100*a* of the cylinder 100 is compressed, and is then discharged out of the cylinder 100 through the refrigerant outlet port 100*b* of the cylinder 100, the communication hole 53 of the actuator 5, and the valve outlet port 12. While introduction of the refrigerant gas through the valve inlet port 11 is interrupted, the refrigerant gas in the cylinder 100 is repetitively circulated and discharged through the communication groove 51 of the actuator 5. In this way, the refrigerant inlet port 100*a* of the cylinder 100 communicates with the refrigerant outlet port 100*b* of the cylinder 100 through the communication groove 51 of the actuator 5.

Figure 5A:
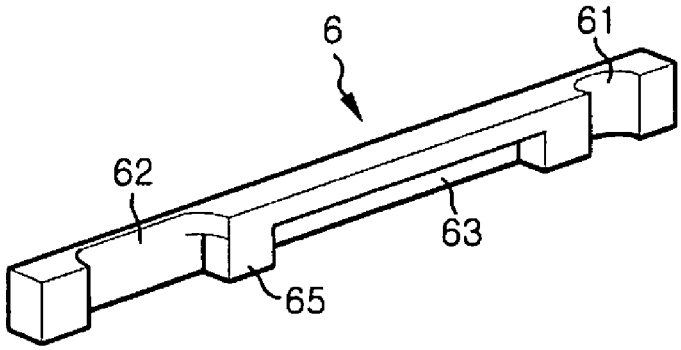
Figure 5B:
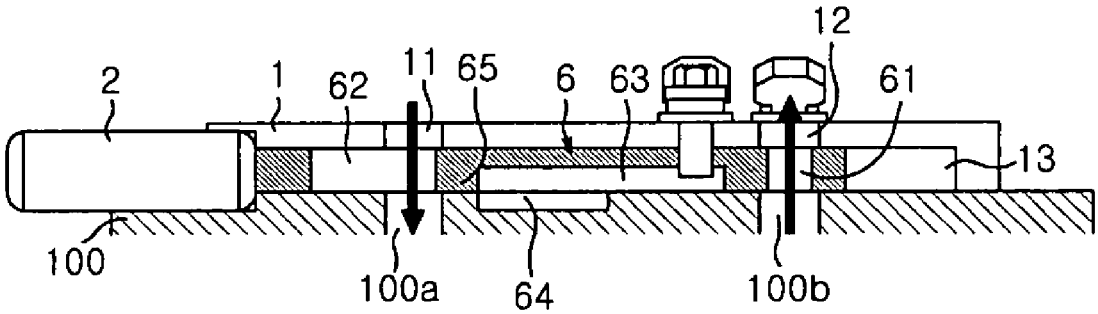
Figure 5C:
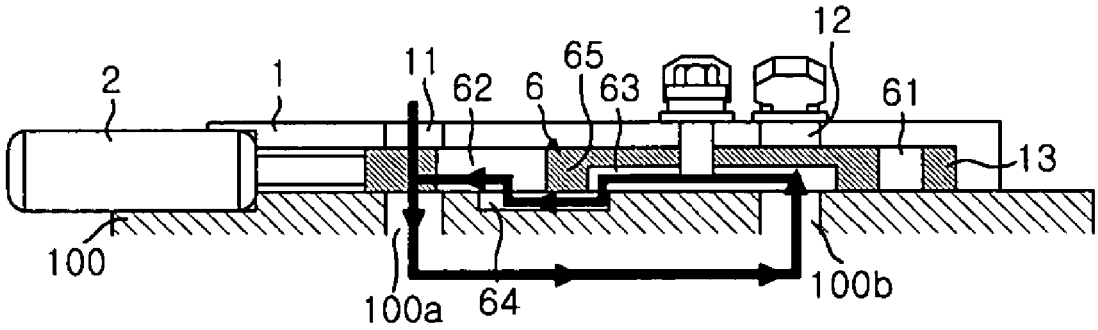

FIGS. 5A to 5C illustrate a smart control valve for compressors according to a fourth preferred embodiment of the present invention.

FIG. 5A is a perspective view illustrating an actuator 6. As shown in FIG. 5A, the actuator 6 has a discharge side opening/closing hole 61 formed at one longitudinal side of the actuator 6. The discharge side opening/closing hole 61 vertically extends through the actuator 6. Also, the actuator 6 has an elongated suction hole 62 formed at the other longitudinal side of the actuator 6. The elongated suction hole 62 has an elliptical section. At the lower part of the actuator 6, between the elongated suction hole 62 and the discharge side opening/closing hole 61, is formed a communication groove 63, opposite ends of which are closed. The communication groove 63 does not communicate with the elongated suction hole 62 and discharge side opening/closing hole 61. Between the elongated suction hole 62 and the communication groove 63 is disposed a suction guide 65. Correspondingly, the cylinder 100 has an upper open groove 64, which is disposed between the refrigerant inlet port 100*a* of the cylinder 100 and the refrigerant outlet port 100*b* of the cylinder 100. The upper open groove 64 of the cylinder 100 is opposite to the communication groove 63 of the actuator 6.

When the actuator 6 is moved rearward by the solenoid 2, as shown in FIG. 5B, the discharge side opening/closing hole 61 is aligned with the refrigerant outlet port 100*b* of the cylinder 100 and the valve outlet port 12. As a result, the refrigerant outlet port 100*b* of the cylinder 100 communicates with the valve outlet port 12 through the discharge side opening/closing hole 61. Also, the refrigerant inlet port 100*a* of the cylinder 100 communicates with the valve inlet port 11 through the elongated suction hole 62. At this time, the communication groove 63, which is disposed between the elongated suction hole 62 and the discharge side opening/closing hole 61, does not communicate with the refrigerant inlet port 100*a* of the cylinder 100 as well as the refrigerant outlet port 100*b* of the cylinder 100.

Consequently, refrigerant gas is introduced into the cylinder 100 through the valve inlet port 11, the elongated suction hole 62, and the refrigerant inlet port 100*a* of the cylinder 100. The refrigerant gas introduced into the cylinder 100 is compressed, and is then discharged out of the cylinder 100 through the refrigerant outlet port 100*b* of the cylinder 100, the discharge side opening/closing hole 61 of the actuator 6, and the valve outlet port 12. In this way, compression in the compression chamber of the cylinder 100 is accomplished.

When the actuator 6 is moved forward by the solenoid 2, as shown in FIG. 5C, on the other hand, the discharge side opening/closing hole 61 of the actuator 6 is not aligned with the refrigerant outlet port 100*b* of the cylinder 100 and the valve outlet port 12. As a result, the refrigerant outlet port 100*b* of the cylinder 100 does not communicate with the valve outlet port 12, and the communication groove 63 communicates with the refrigerant outlet port 100*b* of the cylinder 100. At this time, the refrigerant inlet port 100*a* of the cylinder 100 still communicates with the valve inlet port 11 through the elongated suction hole 62 of the actuator 6. Consequently, refrigerant gas discharged through the refrigerant outlet port 100*b* of the cylinder 100 is introduced into the communication groove 63.

Also, the suction guide 65 of the actuator 6 is placed in the upper open groove 64 of the cylinder 100. As a result, the communication groove 63 communicates with the elongated suction hole 62 through the upper open groove 64 of the cylinder 100. Consequently, the refrigerant gas introduced into the communication groove 63 is introduced into the elongated suction hole 62 through the upper open groove 64. In this way, the refrigerant inlet port 100*a* of the cylinder 100 communicates with the refrigerant outlet port 100*b* of the cylinder 100.

When the compression is performed as shown in FIG. 5B, the suction guide 65 serves to prevent low-temperature refrigerant gas introduced through the elongated suction hole 62 of the actuator 6 from flowing to the refrigerant outlet port 100*b* of the cylinder 100, through which compressed high-temperature refrigerant gas is discharged. Consequently, undesired preheating of the low-temperature refrigerant gas is effectively prevented by the provision of the suction guide 65.

Figure 6A:
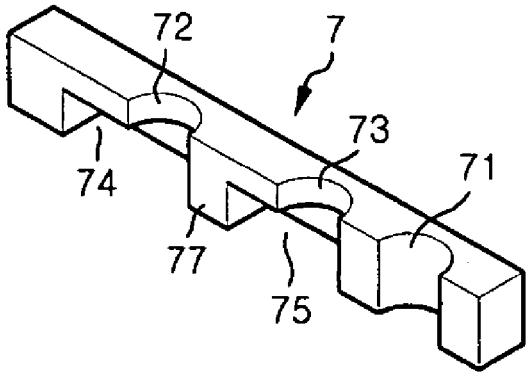
Figure 6B:
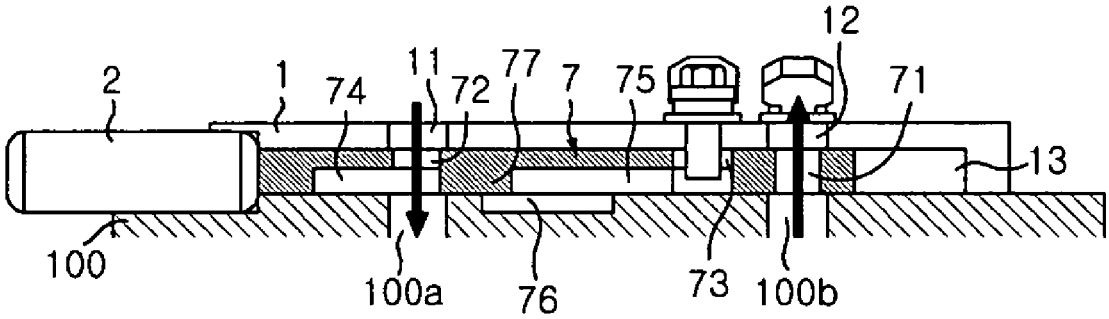
Figure 6C:
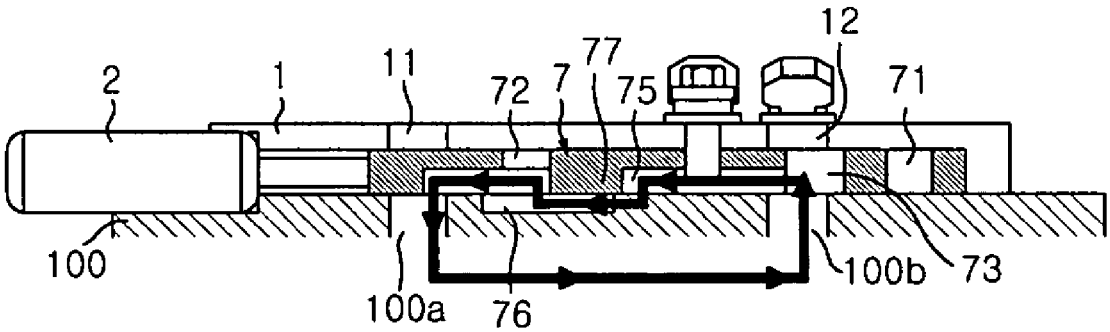

FIGS. 6A to 6C illustrate a smart control valve for compressors according to a fifth preferred embodiment of the present invention.

FIG. 6A is a perspective view illustrating an actuator 7. The actuator 7 has a discharge side opening/closing hole 71 formed at one longitudinal side of the actuator 7. The discharge side opening/closing hole 71 vertically extends through the actuator 7. Also, the actuator 7 has a suction side opening/closing hole 72 formed at the other longitudinal side of the actuator 7. Between the suction side opening/closing hole 72 and the discharge side opening/closing hole 71 is disposed a communication hole 73.

At the actuator 7, under the suction side opening/closing hole 72, is formed a first communication groove 74, which communicates with the suction side opening/closing hole 72. Opposite ends of the first communication groove 74 are closed. At the actuator 7, under the communication hole 73, is formed a second communication groove 75, which communicates with the communication hole 73. Opposite ends of the second communication groove 75 are also closed. Between the first communication groove 74 and the second communication groove 75 is disposed a suction guide 77. Correspondingly, the cylinder 100 has an upper open groove 76, which is disposed between the refrigerant inlet port 100*a* of the cylinder 100 and the refrigerant outlet port 100*b* of the cylinder 100. The upper open groove 76 of the cylinder 100 is opposite to the first communication groove 74 and the second communication groove 75.

When the actuator 7 is moved rearward by the solenoid 2, as shown in FIG. 6B, the valve inlet port 11 communicates with the refrigerant inlet port 100*a* of the cylinder 100 through the suction side opening/closing hole 72 and the first communication groove 74, and the valve outlet port 12 communicates with the refrigerant outlet port 100*b* of the cylinder 100 through the discharge side opening/closing hole 71.

At this time, the suction guide 77 of the actuator 7 serves to prevent low-temperature refrigerant gas introduced through the suction side opening/closing hole 72 from flowing to the refrigerant outlet port 100*b* of the cylinder 100, through which compressed high-temperature refrigerant gas is discharged. The second communication groove 75, which is disposed between the suction side opening/closing hole 72 and the discharge side opening/closing hole 71, does not communicate with the refrigerant inlet port 100*a* of the cylinder 100 as well as the refrigerant outlet port 100*b* of the cylinder 100.

Consequently, refrigerant gas is introduced into the cylinder 5 through the valve inlet port 11, the suction side opening/closing hole 72 and the first communication groove 74 of the actuator 7, and the refrigerant inlet port 100*a* of the cylinder 100, and is then compressed in the cylinder 100. The compressed refrigerant gas is discharged out of the cylinder 100 through the refrigerant outlet port 100*b* of the cylinder 100, the discharge side opening/closing hole 71 of the actuator 7, and the valve outlet port 12. In this way, compression in the compression chamber of the cylinder 100 is accomplished.

When the actuator 7 is moved forward by the solenoid 2, as shown in FIG. 6C, on the other hand, the suction side opening/closing hole 72 of the actuator 7 is not aligned with the valve inlet port 11 and the refrigerant inlet port 100*a* of the cylinder 100. As a result, the valve inlet port 11 does not communicate with the refrigerant inlet port 100*a* of the cylinder 100. However, the first communication groove 74 still communicates with the refrigerant inlet port 100*a* of the cylinder 100.

Also, the discharge side opening/closing hole 71 of the actuator 7 is not aligned with the valve outlet port 12 and the refrigerant outlet port 100*b* of the cylinder 100. However, the communication hole 73 and the second communication groove 75 communicate with the valve outlet port 12 and the refrigerant outlet port 100*b* of the cylinder 100. Also, the suction guide 77, which is disposed between the first communication groove 74 and the second communication groove 75, is placed in the middle of the upper open groove 76 of the cylinder 100. As a result, the first communication groove 74 communicates with the second communication groove 75.

Consequently, the refrigerant gas introduced into the cylinder 100 is compressed while further introduction of refrigerant gas is interrupted, and is then discharged out of the cylinder 100 through the refrigerant outlet port 100*b* of the cylinder 100, the communication hole 73 of the actuator 7, and the valve outlet port 12. At this time, some of the compressed refrigerant gas is introduced into the refrigerant inlet port 100*a* of the cylinder 100 through the second communication groove 75 of the actuator 7, the upper open groove 76 of the cylinder 100, and the first communication groove 74 of the actuator 7. Consequently, the refrigerant inlet port 100*a* of the cylinder 100 communicates with the refrigerant outlet port 100*b* of the cylinder 100.

Figure 7A:
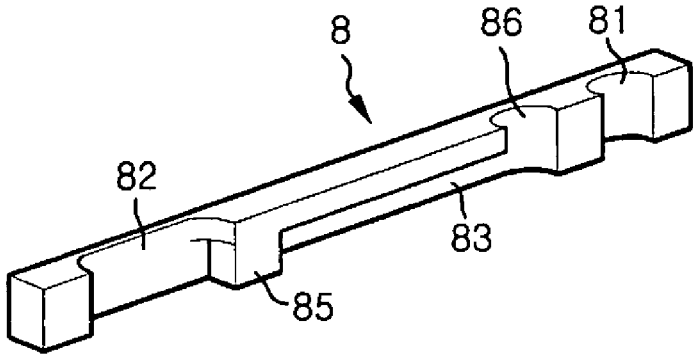
Figure 7B:
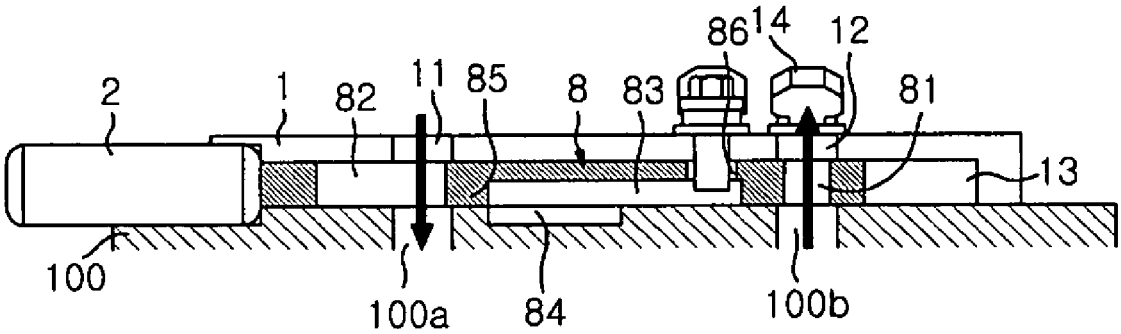
Figure 7C:
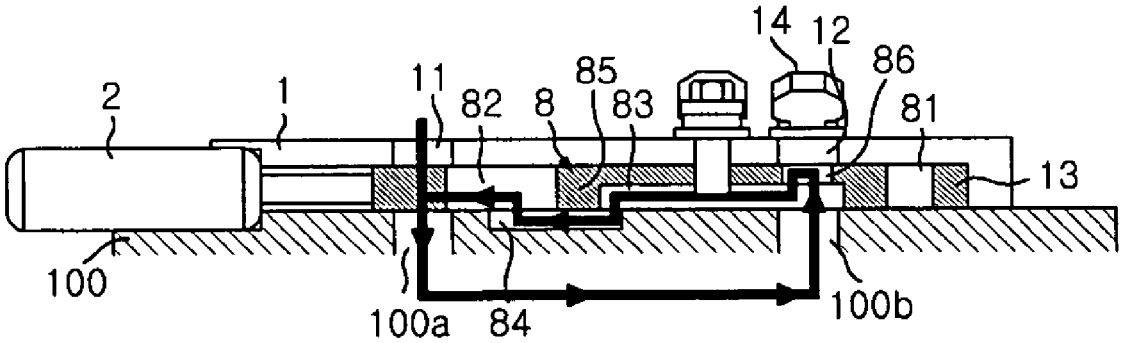

FIGS. 7A to 7C illustrate a smart control valve for compressors according to a sixth preferred embodiment of the present invention.

FIG. 7A is a perspective view illustrating an actuator 8. As shown in FIG. 7A, the actuator 8 has first and second discharge side opening/closing holes 81 and 86 formed at one longitudinal side of the actuator 8. The first and second discharge side opening/closing holes 81 and 86 vertically extend through the actuator 8. Also, the actuator 8 has an elongated suction hole 82 formed at the other longitudinal side of the actuator 8. The elongated suction hole 82 has an elliptical section. At the lower part of the actuator 8, between the elongated suction hole 82 and the first discharge side opening/closing hole 81, is formed a communication groove 83, opposite ends of which are closed. The communication groove 83 is constructed such that the communication groove 83 communicates with the second discharge side opening/closing hole 86, but the communication groove 83 does not communicate with the elongated suction hole 82 and discharge side opening/closing hole 81. Between the elongated suction hole 82 and the communication groove 83 is disposed a suction guide 85. Correspondingly, the cylinder 100 has an upper open groove 84, which is disposed between the refrigerant inlet port 100*a* of the cylinder 100 and the refrigerant outlet port 100*b* of the cylinder 100. The upper open groove 184 of the cylinder 100 is opposite to the communication groove 83 of the actuator 8.

When the actuator 8 is moved rearward by the solenoid 2, as shown in FIG. 7B, the first discharge side opening/closing hole 81 is aligned with the refrigerant outlet port 100*b* of the cylinder 100 and the valve outlet port 12. As a result, the refrigerant outlet port 100*b* of the cylinder 100 communicates with the valve outlet port 12 through the first discharge side opening/closing hole 81. Also, the refrigerant inlet port 100*a* of the cylinder 100 communicates with the valve inlet port 11 through the elongated suction hole 82. At this time, the communication groove 83, which is disposed between the elongated suction hole 82 and the first discharge side opening/closing hole 81, does not communicate with the refrigerant inlet port 100*a* of the cylinder 100 as well as the refrigerant outlet port 100*b* of the cylinder 100.

Consequently, refrigerant gas is introduced into the cylinder 100 through the valve inlet port 11, the elongated suction hole 82, and the refrigerant inlet port 100*a* of the cylinder 100. The refrigerant gas introduced into the cylinder 100 is compressed, and is then discharged out of the cylinder 100 through the refrigerant outlet port 100*b* of the cylinder 100, the first discharge side opening/closing hole 81 of the actuator 8, and the valve outlet port 12. In this way, compression in the compression chamber of the cylinder 100 is accomplished.

When the actuator 8 is moved forward by the solenoid 2, as shown in FIG. 7C, on the other hand, the first discharge side opening/closing hole 81 of the actuator 8 is not aligned with the refrigerant outlet port 100*b* of the cylinder 100 and the valve outlet port 12. At this time, the second discharge side opening/closing hole 86 and the communication groove 83 of the actuator 8 communicate with the refrigerant outlet port 100*b* of the cylinder 100 and the valve outlet port 12. However, the suction pressure of the refrigerant gas introduced through the elongated suction hole 82 of the actuator 8 is applied to a discharge reed valve 14. As a result, the discharge reed valve 14 is operated by the difference between the suction pressure applied to the discharge reed valve 14 and the discharge pressure from the discharge reed valve 14, and therefore, the valve outlet port 12 is closed. At this time, the refrigerant inlet port 100*a* of the cylinder 100 still communicates with the valve inlet port 11 through the elongated suction hole 82 of the actuator 8.

Also, the suction guide 85 of the actuator 8 is placed in the upper open groove 84 of the cylinder 100. As a result, the communication groove 83 communicates with the elongated suction hole 82 through the upper open groove 84 of the cylinder 100.

Consequently, the refrigerant gas discharged through the refrigerant outlet port 100*b* of the cylinder 100 is introduced into the second discharge side opening/closing hole 86 and the communication groove 83 of the actuator 8, and is then introduced into the elongated suction hole 82 through the upper open groove 84 of the cylinder 100. In this way, the refrigerant inlet port 100*a* of the cylinder 100 communicates with the refrigerant outlet port 100*b* of the cylinder 100.

When the compression is performed as shown in FIG. 7B, the suction guide 85 serves to prevent low-temperature refrigerant gas introduced through the elongated suction hole 82 of the actuator 8 from flowing to the refrigerant outlet port 100*b* of the cylinder 100, through which compressed high-temperature refrigerant gas is discharged. Consequently, undesired preheating of the low-temperature refrigerant gas is effectively prevented by the provision of the suction guide 85.

The smart control valve for compressors according to the sixth preferred embodiment of the present invention is characterized in that the suction pressure is applied to the discharge reed valve 14 through the second discharge side opening/closing hole when no-load operation of the compressor is performed, and therefore, operability of the valve is improved, and in that the discharge reed valve 14 is operated by the difference between the suction pressure applied to the discharge reed valve 14 and the discharge pressure from the discharge reed valve 14, and therefore, the sealing of the discharge reed valve 14 is improved.

Figure 8:
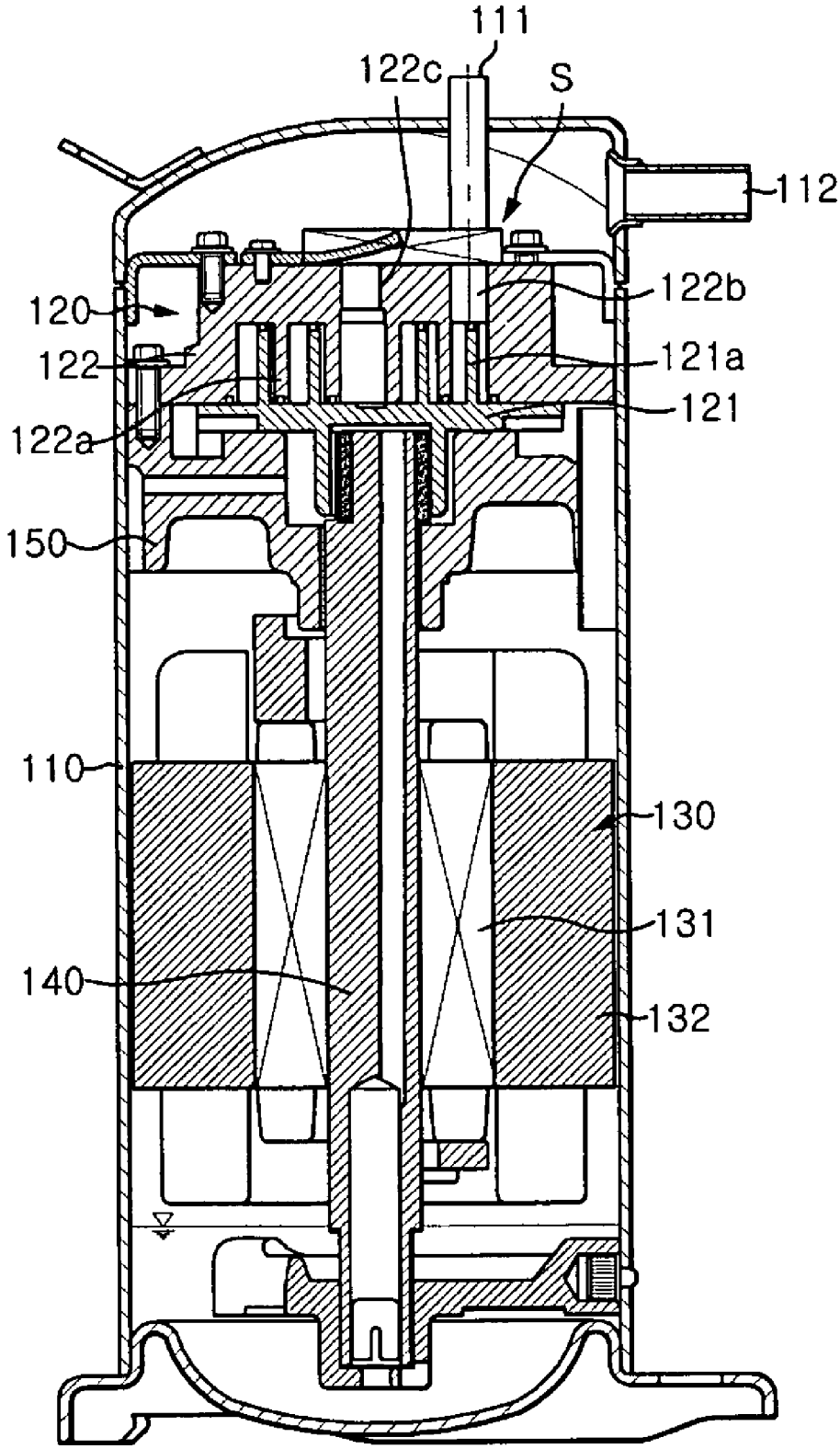
FIG. 8 is a longitudinal sectional view illustrating a scroll compressor, to which the smart control valve according to the present invention is applied.

FIG. 8 is a longitudinal sectional view illustrating a scroll compressor, to which the smart control valve according to the present invention is applied.

As shown in FIG. 8, the scroll compressor comprises a compression unit 120 and a drive unit 130 mounted in a shell 110 having a refrigerant inlet tube 111 and a refrigerant outlet tube 112. The compression unit 120 is disposed above the drive unit 130 in the shell 110. The compression unit 120 and the drive unit 130 are connected to each other via a crankshaft 140, opposite ends of which are supported by a main frame 150 and a subsidiary frame 160, respectively.

The drive unit 130 comprises: a rotor 131, through the center of which the crankshaft 140 longitudinally extends; and a stator 132 disposed around the rotor 131.

The compression unit 120 comprises: an orbiting scroll 121 connected to the crankshaft 140 at the lower part thereof and having an involute-shaped orbiting wrap 121*a* formed at the upper part thereof; and a stationary scroll 122 disposed on the orbiting scroll 121 and having a stationary wrap 122*a* formed at the lower part thereof. The orbiting wrap 121*a* of the orbiting scroll 121 is engaged with the stationary wrap 122*a* of the stationary scroll 122. As the orbiting scroll 121 performs an orbiting movement according to rotation of the crankshaft 140, refrigerant gas is compressed in a compression chamber defined between the orbiting wrap 121*a* and the stationary wrap 122*a*.

A smart control valve S according to the present invention is mounted on the upper surface of the stationary scroll 122 of the scroll compressor for opening or closing a refrigerant inlet port 122*b* and a refrigerant outlet port 122*c* of the stationary scroll 122. By the opening or closing operation of the smart control valve S, communication or compression is accomplished in the compression chamber defined between the orbiting wrap 121*a* and the stationary wrap 122*a*. The refrigerant inlet port 122*b* and the refrigerant outlet port 122*c* are formed at the upper part of the stationary scroll 122. Specifically, the refrigerant outlet port 122*c* is formed at the center of the upper part of the stationary scroll 122. The refrigerant inlet tube 111 is vertically connected to the refrigerant inlet port 122*b* of the stationary scroll 122.

The compression and communication process in the scroll compressor having the smart control valve mounted therein is identical to the processes described above in connection with the smart control valves according to first to sixth preferred embodiments of the present invention. Therefore, a detailed description of the compression and communication process in the scroll compressor will not be given.

Figure 9:
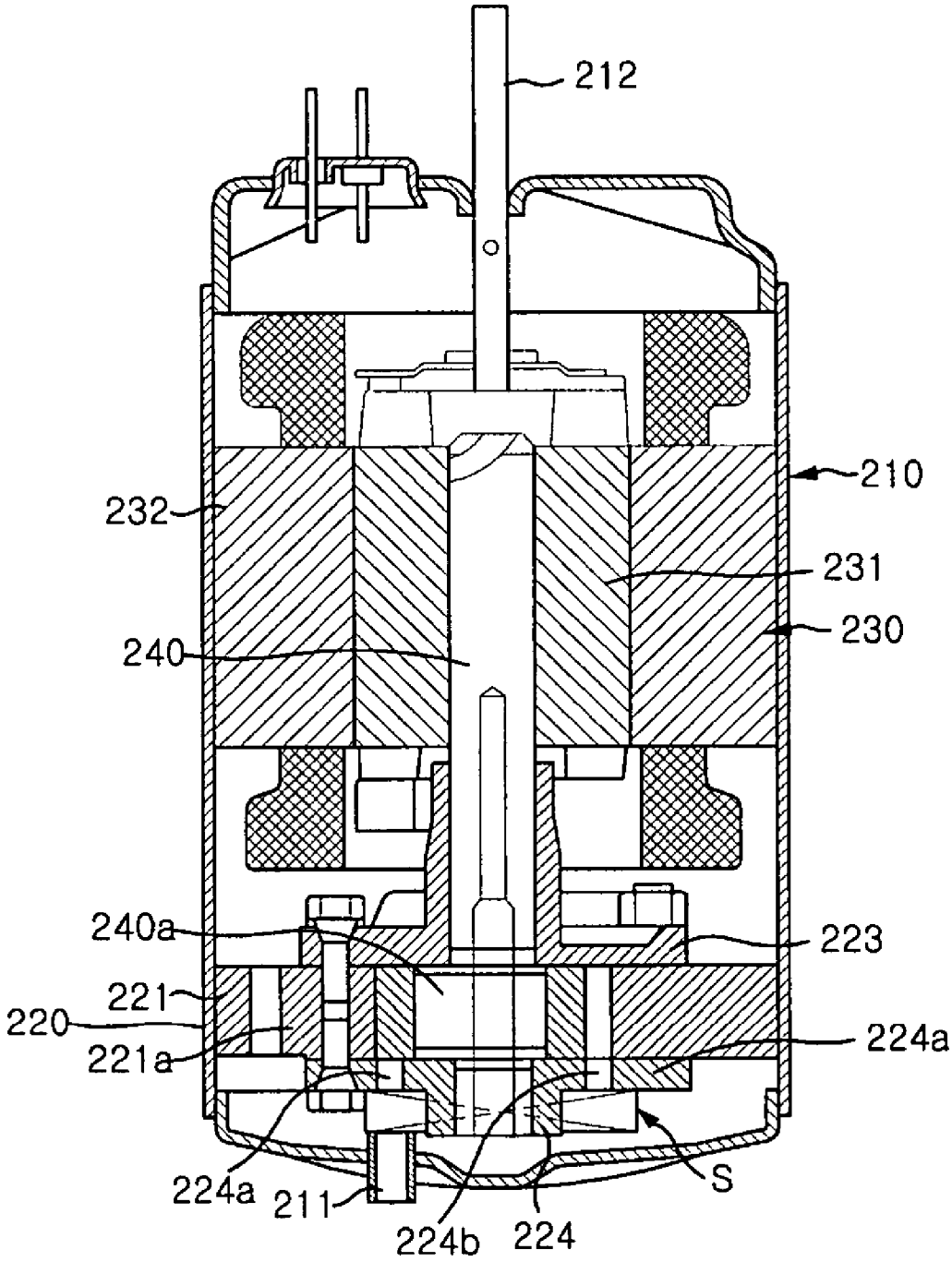
FIG. 9 is a longitudinal sectional view illustrating a rotary compressor, to which the smart control valve according to the present invention is applied.

FIG. 9 is a longitudinal sectional view illustrating a rotary compressor, to which the smart control valve according to the present invention is applied.

As shown in FIG. 9, the rotary compressor comprises a compression unit 220 and a drive unit 230 mounted in a hermetically sealed container 210 having a refrigerant inlet tube 211 and a refrigerant outlet tube 212. The compression unit 220 is disposed below the drive unit 230 in the container 210. The compression unit 220 and the drive unit 230 are connected to each other via a rotary shaft 240.

The compression unit 220 comprises: a cylinder 221 having a compression chamber defined therein; and a roller 222 slidably and rotatably disposed in the cylinder 221. The roller 222 is connected to an eccentric part 240*a* formed at the rotary shaft 240 such that the roller 222 performs an eccentric rotation as the rotary shaft 240 is operated. Refrigerant introduced into the cylinder 221 through a refrigerant inlet port 224*a* is compressed by the eccentric rotation of the roller 222.

The drive unit 230 comprises: a rotor 231, through the center of which the rotary shaft 240 longitudinally extends; and a stator 232 disposed around the rotor 231 for generating a magnetic field. The rotary shaft 240 is supported by an upper flange 223, which is disposed above the cylinder 221, and a lower flange 224, which is disposed below the cylinder 221.

A smart control valve S according to the present invention is mounted on the lower surface of the lower frame 224 of the rotary compressor for opening or closing a refrigerant inlet port 224*a* and a refrigerant outlet port 224*b* formed at the lower flange 224. By the opening or closing operation of the smart control valve S, communication or compression is accomplished in the compression chamber of the cylinder 221.

The refrigerant inlet port 224*a* and the refrigerant outlet port 224*b* are formed at the lower part of the lower flange 224. Refrigerant gas discharged through the refrigerant outlet port 224*b* and the smart control valve S during compression is guided into the hermetically sealed container 210 through a discharge channel 221*a* vertically extending through the cylinder 221, and is then discharged out of the hermetically sealed container 210 through the refrigerant outlet tube 212.

The operation of the smart control valve S for opening and closing the refrigerant inlet port 224*a* and the refrigerant outlet port 224*b* of the lower flange 224 is identical to those described above in connection with the smart control valves according to first to sixth preferred embodiments of the present invention. Therefore, a detailed description of the operation of the smart control valve in the rotary compressor will not be given.

Meanwhile, the above-specified scroll compressor and rotary compressor are merely examples given to describe the present invention, and therefore, the present invention is limited to the above-specified scroll compressor and rotary compressor. Consequently, the present invention is applicable to any kinds of compressors so long as the refrigerant inlet port and the refrigerant outlet port are opened and closed to accomplish communication and compression in the compression chamber. Especially when the compressor has a plurality of compression chambers, i.e., inner and outer compression chambers, a pair of smart control valves may be mounted at the inner and outer compression chambers, respectively. For a twin compressor, i.e., a compressor having a plurality of compression units, which are vertically disposed, smart control valves may be mounted at the respective compression units.

According to the present invention, the capacity of the compressor is changed based on a pulse width modulation (hereinafter, referred to as "PWM") control system. The PWM control serves to adjust a duty ratio of a pulse signal. Here, the duty ratio is a ratio of time (T(h)) for "High" signal to a period (T).

For example, a DC motor is operated when electric current is supplied to the DC motor, and stopped when electric current is not supplied to the DC motor. When the on and off operation of the DC motor is repetitively performed at short intervals, it seems that the DC motor is slowly operated.

When the compression and communication process in the compression chamber is periodically repeated using the smart control valve according to the present invention based on the above-mentioned control system, the capacity of the compressor is changed. If the duty ratio is 95%, compression is accomplished in the compression chamber approximately with the maximum compression efficiency of the compression unit. If the duty ratio is 50%, on the other hand, compression is accomplished in the compression chamber at approximately half the maximum compression efficiency of the compression unit.

As apparent from the above description, the present invention provides a smart control valve for compressors that is capable of easily accomplishing compression and communication in a compression chamber of a cylinder, without performing the repetitive on/off operation of the compressor, to change the capacity of the compressor. Consequently, the present invention has the effect of accomplishing economical efficiency of the compressor, reducing power consumption due to repetitive on/off operation of the compressor, preventing reduction in service life of the compressor due to premature wear of the parts of the compressor, and therefore, improving the performance and reliability of the compressor.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A smart control valve for compressors, comprising:

a valve body mounted on a cylinder including a refrigerant inlet port and a refrigerant outlet port;

a valve inlet port formed at the valve body, the valve inlet port communicating with the refrigerant inlet port of the cylinder;

a valve outlet port formed at the valve body, the valve outlet port communicating with the refrigerant outlet port of the cylinder;

an actuating groove disposed under the valve inlet port and the valve outlet port of the valve body, the actuating groove being opened at one side thereof; and an actuator disposed in the actuating groove for performing a linear reciprocating movement in the actuating groove as a solenoid is operated, wherein the actuator includes:

a communication groove formed at the lower part thereof, opposite ends of the communication groove being closed;

a suction side opening/closing hole disposed above the communication groove adjacent to one side of the lower communication groove, the suction side opening/closing hole communicating with the communication groove;

a communication hole disposed above the communication groove adjacent to the other side of the lower communication groove, the communication hole communicating with the communication groove; and a discharge side opening/closing hole disposed adjacent to the communication hole for allowing or interrupting communication between the valve outlet port and the refrigerant outlet port of the cylinder.

2. A variable capacity type compressor comprising:

a hermetically sealed container having an inlet tube and an outlet tube; and a compression unit mounted in the hermetically sealed container, while being connected to a drive unit via a shaft, for compressing refrigerant gas introduced through the inlet tube as the shaft is rotated by the drive unit, wherein the compression unit comprises:

a cylinder including a refrigerant inlet port and a refrigerant outlet port;

a valve body having a valve inlet port, which corresponds to the refrigerant inlet port of the cylinder, and a valve outlet port, which corresponds to the refrigerant outlet port of the cylinder;

an actuating groove disposed under the valve inlet port and the valve outlet port of the valve body, the actuating groove being opened at one side thereof; and an actuator disposed in the actuating groove such that the actuator performs a linear reciprocating movement in the actuating groove, as a solenoid is operated, for allowing or interrupting communication between the valve inlet port and the refrigerant inlet port of the cylinder and between the refrigerant outlet port of the cylinder and the valve outlet port to accomplish communication or compression in a compression chamber defined in the cylinder, and wherein the actuator includes:

a communication groove formed at the lower part thereof, opposite ends of the communication groove being closed;

a suction side opening/closing hole disposed above the communication groove adjacent to one side of the lower communication groove, the suction side opening/closing hole communicating with the communication groove;

a communication hole disposed above the communication groove adjacent to the other side of the lower communication groove, the communication hole communicating with the communication groove; and a discharge side opening/closing hole disposed adjacent to the communication hole for allowing or interrupting communication between the valve outlet port and the refrigerant outlet port of the cylinder.

* * * * *